United States Patent [19]

Perry

[11] 4,369,592

[45] Jan. 25, 1983

[54] PROPELLING METHOD AND DEVICE

[76] Inventor: J. E. Perry, P.O. Box 483, Murrells Inlet, S.C. 29576

[21] Appl. No.: 208,147

[22] Filed: Nov. 19, 1980

[51] Int. Cl.[3] ..... F41C 3/06

[52] U.S. Cl. ..... 42/54

[58] Field of Search ..... 42/54, 55, 58, 15, 94

[56] References Cited

U.S. PATENT DOCUMENTS

| | | | |
|---|---|---|---|
| 758,374 | 4/1904 | Mason | 42/54 |
| 771,751 | 10/1904 | Sanguinet | 42/54 |
| 859,562 | 7/1907 | Johnson | 42/55 |
| 3,474,560 | 10/1969 | Ramsay | 42/15 |
| 3,938,272 | 2/1976 | Ditto et al. | 42/55 |
| 3,938,273 | 2/1976 | Tellié | 42/94 |

*Primary Examiner*—Charles T. Jordan

*Attorney, Agent, or Firm*—Larry Harold Kline

[57] ABSTRACT

A method and device are disclosed for propelling an object from a device that comprises a loading chamber, a loading mechanism, and a firing chamber portion with an open end.

16 Claims, 13 Drawing Figures

PROPELLING METHOD AND DEVICE

This invention relates to a method and device and more particularly to a method and device which can be utilized for the propelng of an object from the device.

Many children and adults utilize explosive devices, such as firecrackers, for fun and pleasure. The present invention is a novel method and device for the safe use of explosive devices, such as firecrackers, for propelling an object, such as a ball, in the manner of a weapon. The present invention may be utilized by hand, or with a stock as a gun or rifle, or ground secured.

An object of the present invention is to provide a device in which an explosive device, such as a firecracker, may be utilized for propelling an object out of the device.

Another object of the present invention is to provide a device which can be utilized with or without a stock, hand held, or ground secured for propelling an object from the device.

A further object of the present invention is to provide a firing chamber within which an explosive device, such as a firecracker, may explode utilizing the force of the explosion to propel an object from the device.

Still another object of the present invention is to provide a method for propelling an object from a device which comprises a loading chamber, a loading mechanism, and a firing chamber portion.

Another object of the present invention is to provide an expolosive device holding slot in which the explosive device, such as a firecracker, may be easily secured and safely ignited prior to placing the explosive device or firecracker into the firing chamber of the device.

A further object of the present invention is to provide securing means for attaching a stock to the device which utilizes the force of an explosive device, such as a firecracker, to propel an object from the device.

Still another object of the present invention is to provide securing means for the attachment of ground stablizing legs to the device which utilizes the force of an explosive device, such as a firecracker, to propel an object from the device.

These and other objects and features of the invention will be apparent from the following description and appended claims.

Briefly, the invention is a method and a device for propelling an object from a device. The method for propelling an object from a device comprising a loading chamber, a loading mechanism, and a firing chamber portion comprises placing the object in the open end of the firing chamber portion. An explosive device with a fuse is positioned within the loading mechanism with the loading mechanism secured within the loading chamber of the device. The fuse of the explosive device is ignited. The portion of the loading mechanism holding the explosive device is injected into the firing chamber portion of the device. The explosive device is dropped from the loading mechanism into the firing chamber portion. The explosive device explodes propelling the object from the device. The explosive device may be a firecracker. The loading mechanism comprises a holding slot within which the explosive device is positioned. The holding slot has a recessed portion within which a portion of the explosive device is placed. A portion of the loading mechanism is permanently placed within the firing chamber portion to act as guide in injecting the portion of the loading mechanism holding the explosive device into the firing chamber portion of the device. The device is propelling an object by use of the explosive device comprises a loading chamber, a loading mechanism, and a firing chamber portion. The explosive device is placed into the loading chamber of the device. The firing chamber portion is secured o the loading chamber and is operative for the explosive device to explode within. The loading mechanism is secured within the loading chamber and extends into the firing chamber portion of the device. The loading mechanism is operative to hold the explosive device. When the object is placed within the open end prior to the explosive device exploding the object will be propelled from the device upon the explosion of the explosive device. The loading chamber comprises a first opening within which the explosive device may be placed and a second opening through which the loading mechanism can be moved to place the explosive device within the firing chamber portion. The second opening comprises a horizontal section and a vertical section whereby the loading mechanism can be moved horizontally to place the explosive device in the firing chamber portion and vertically to drop the explosive device into the firing chamber portion. The firing chamber portion comprises an open end, a firing chamber, and a rear chamber member with an opening. The loading mechanism extends into the fiing chamber portion through the opening in the rear chamber member. The loading mechanism comprises a shaft, an explosive device holding slot in the end of the shaft, and a handle portion. The handle portion is on the end of the shaft opposite the explosive device holding slot. The explosive device holding slot has a recessed portion in which a portion of the explosive device will be placed and a solid rear portion. The solid rear portion aids in securing the explosive device within the explosive device holding slot.

The invention will be more fully understood from the following detailed description and appended claims when taken with the drawings in which:

Figure 6:
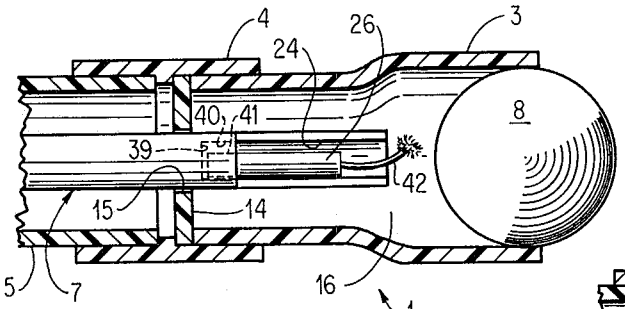

FIG. 6 is a partial sectional view of device 1 showing the explosive device 26 inserted into explosive device holding slot 24 within firing chamber 16.

Figure 7:
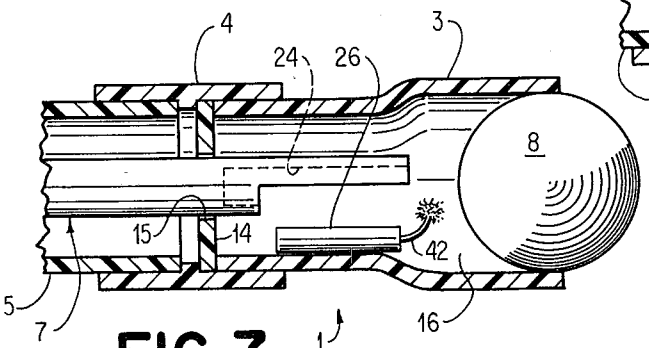

FIG. 7 is a partial sectional view of device 1 showing explosive device 26 dropped into the firing chamber 16 after the loading mechanism 7 has been secured.

Figure 8:
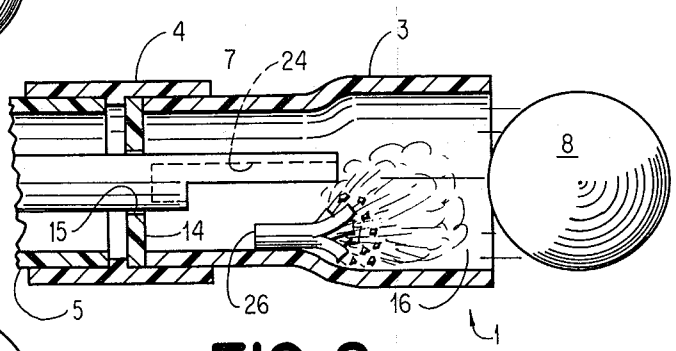

FIG. 8 is a partial sectional view of device 1 showing the explosive device 26 exploding and forcing ball 8 outward from device 1.

Figure 9:
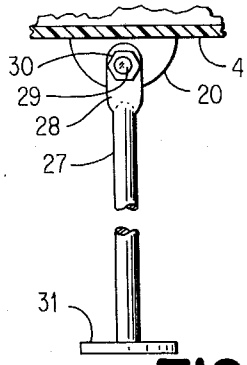

FIG. 9 is a partial elevational view of support leg 27 attached to pivot member 20 which is secured to connecting collar 4.

Figure 10:
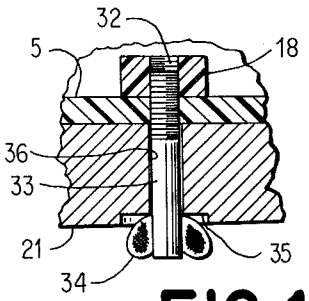

FIG. 10 is a partial sectional view of securing means 33 and its connection through stock 21 and body 5.

Figure 11:
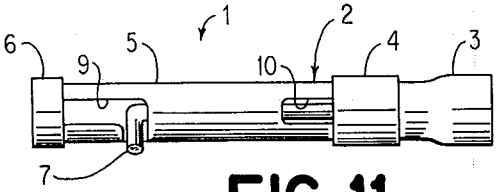

FIG. 11 is an elevational view of device 1 as used for hand-held application.

Figure 12:
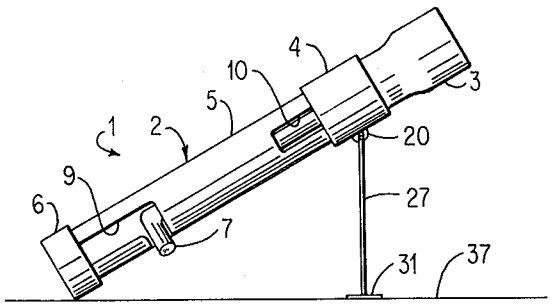

FIG. 12 is an elevational view of device 1 as used in a ground stabilizing arrangement.

Figure 13:
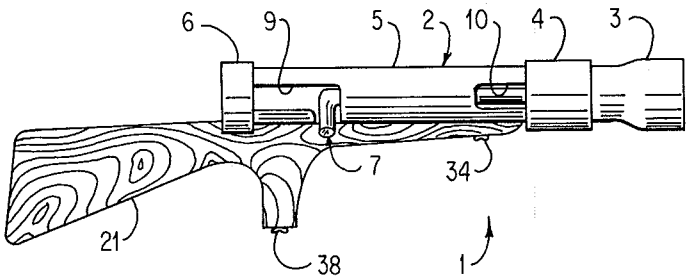

FIG. 13 is an elevational view of device 1 as used in a gun or rifle-type arrangement.

Figure 1:
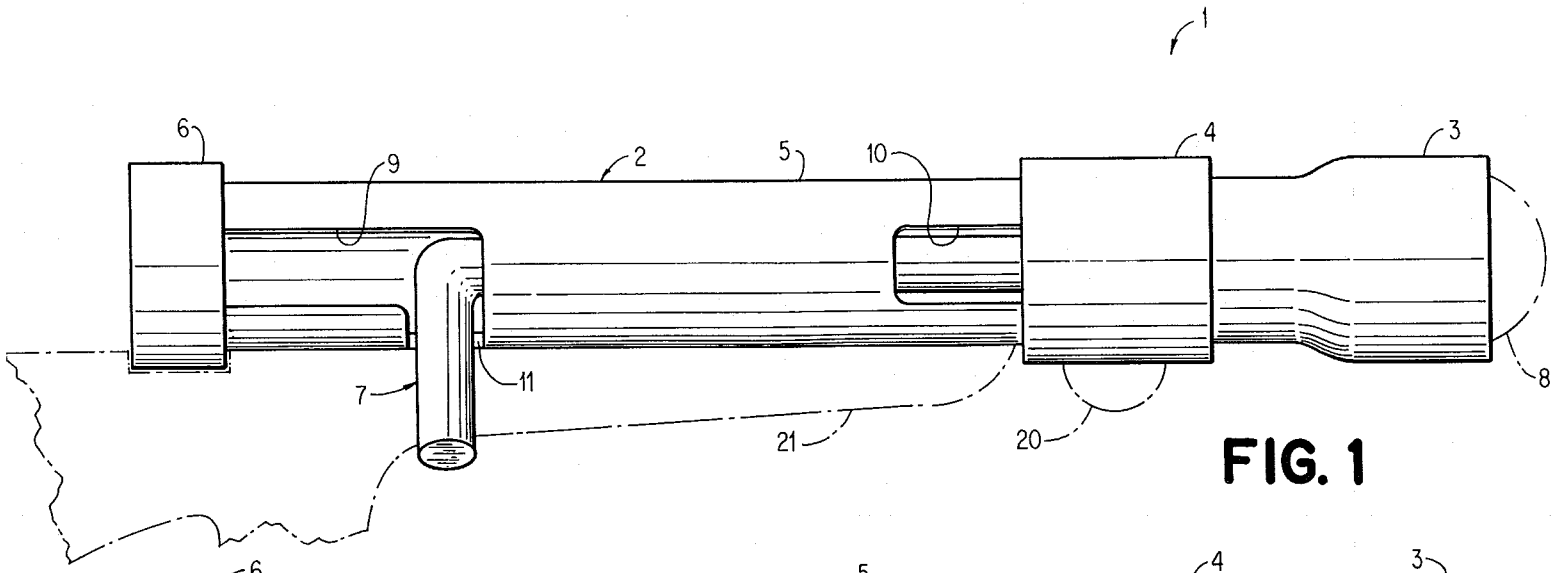
FIG. 1 is a side elevational view of the device.

Referring now to the drawings, FIG. 1 is a side elevational view of device 1. Device 1 comprises loading chamber 2, firing chamber portion 3, and loading mechanism 7. Loading chamber 2 has an outer body 5, end cap 6, and connecting collar 4, which connects loading chamber 5 to firing chamber portion 3. Loading mechanism 7 slides within loading chamber 2 with the end of loading mechanism 7 extending into the firing chamber portion 3. Loading mechanism 7 moves laterally within slide opening 9. Loading mechanism 7 may be locked into position within locking portion 11 of slide opening 9. Loading chamber 2 has a loading opening 10 through which the explosive device 26 may be inserted into loading mechanism 7. A ball 8 or any compressible object 8 may be inserted into the outer opening in firing chamber portion 3 to be expelled from the device 1.

Figure 2:
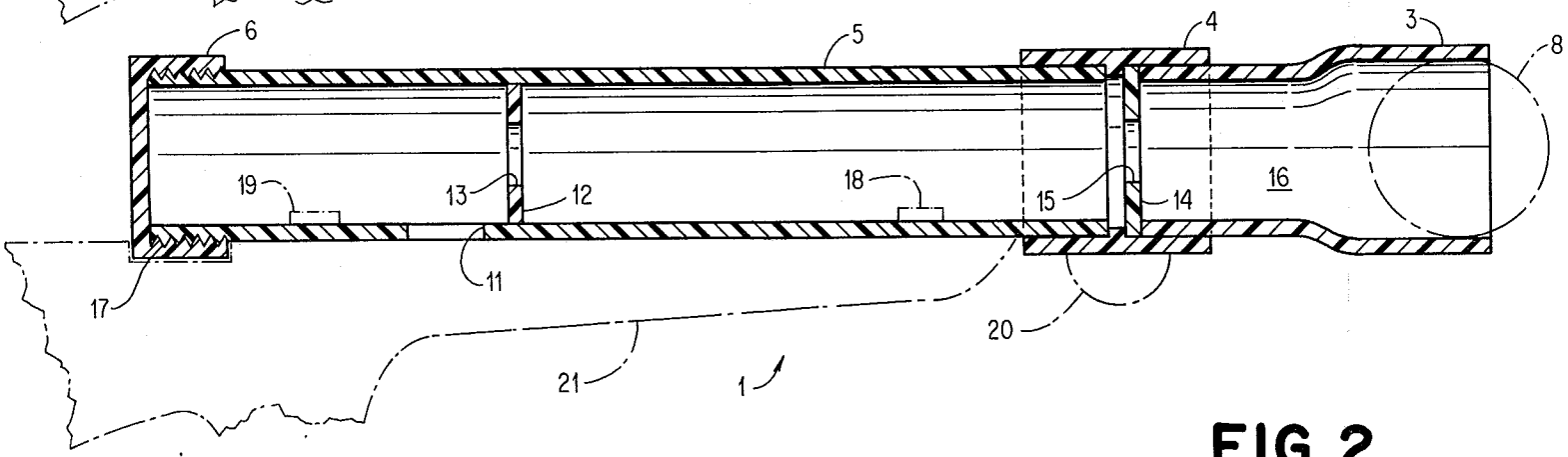
FIG. 2 is a longitudinal sectional view of device 1 with loading mechanism 7 removed.

FIG. 2 is a longitudinal sectional view of device 1 with loading mechanism 7 removed. Device 1 has a rear guide 12 and a front guide 14 to aid in the movement of loading mechanism 7. Rear guide 12 has an opening 13 through which loading mechanism 7 moves. Front guide 14 has an opening 15 through which the loading mechanism moves. Rear guide 12 and front guide 14 stabilize and guide the movement of the loading mechanism 7. Front guide 14 also serves as a rear chamber member 14 in firing chamber portion 3. Firing chamber portion 3 comprises a firing chamber 16. Firing chamber 16 has an open end in which ball 8 may be secured before firing.

End cap 6 has screw threads 17 for attachment of end cap 6 to body 5. Front stock locking element 18 and rear stock locking element 19 are utilized for securing a stock (shown cutoff in dotted lines) to device 1.

Pivot member 20 may be secured to connecting collar 4 for use in securing one or more ground stabilizing legs, such as leg 27 shown in FIG. 12, to device 1.

Figure 3:
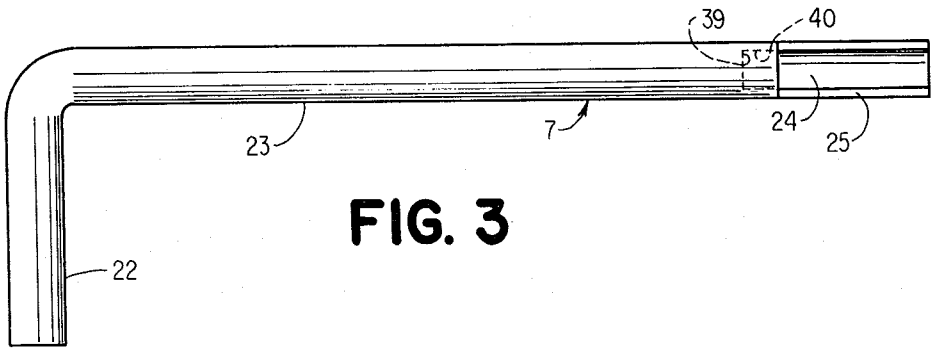
FIG. 3 is a side elevational view of a loading mechanism 7.

FIG. 3 is a side elevational view of loading mechanism 7. Loading mechanism 7 has a handle portion 22 and a shaft 23. In the end of loading mechanism 7 is explosive device holding slot 24 and outer slot body 25. Explosive device holding slot 24 extends into shaft 23 of loading mechanism 7 and to a recessed portion 40. Explosive device holding slot 24 has a solid rear portion 39.

Figure 4:
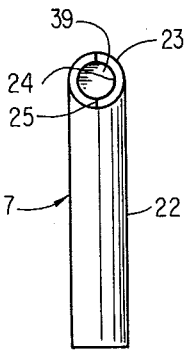
FIG. 4 is a front elevational view of a loading mechanism 7.

FIG. 4 is a front explosive view of loading mechanism 7. Outer slot body 25 forms the portion of explosive device holding slot 24 which is not recessed into shaft 23. Solid rear portion 39 forms the rear of explosive device holding slot 24.

Figure 5:
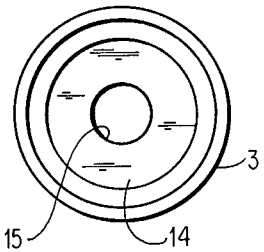
FIG. 5 is a front elevational view of firing chamber portion 3 of device 1.

FIG. 5 is a front elevational view of firing chamber portion 3 of device 1. Front guide and rear chamber member 14 has an opening 15 through which the loading mechanism 7 extends when device 1 is loaded.

FIG. 6 is a partial sectional view of device 1 showing the explosive device 26 inserted into explosive device holding slot 24 within firing chamber 16. When explosive device 26 is placed into explosive device holding slot 24, a recessed portion 41 may be placed within the recessed portion 40 of explosive device holding slot 24. By placing the recessed portion 41 of explosive device 26 into the recessed portion 40 of explosive device holding slot 24, greater stability is obtained when holding the explosive device 26 within the explosive device holding slot 24. Fuse 42 of explosive device 26 is shown ignited.

FIG. 7 is a partial sectional view of device 1 showing explosive device 26 with fuse 42 ignited dropped into the firing chmaber 16 after the loading mechanism 7 has been secured. When the loading mechanism 7 is secured, the handle portion 22 is turned downward into the locking portion 11 of slide opening 9. This causes the causes the explosive device holding slot 24 to turn so that the explosive device 26 with fuse 42 ignited then, by the force of gravity, falls out of the explosive device holding slot 24 and into the firing chamber 16. The shaft 23 of loading mechanism 7 forms a close fit within opening 15 in rear chamber member 14 sealing the firing chamber 16.

FIG. 8 is a partial sectional view of device 1 showing the explosive device 26 exploded and forcing ball 8 outward from device 1. The explosive device 26 may be a simple firecracker 26. The force of firecracker 26 forces the ball 8 outward from the firing chamber 16. The distance that the ball 8 will be propelled will be determined by many factors, such as the weight of the ball 8, the power of the explosive device 26, and the conditions under which the explosion occurs.

FIG. 9 is a partial elevational view of support leg 27 attached to pivot member 20 which is secured to connecting collar 4. One or more support legs, such as support leg 27, can be secured to pivot members, such as pivot member 20, in order to stabilize device 1 for firing in a ground secured position. Support leg 27 has base 31, which is placed upon the ground surface. Support leg 27 has a flattened connecting portion 28, which is secured by connecting bolt 29 and nut 30 to the pivot member 20.

FIG. 10 is a partial sectional view of securing means 33 and its connection through stock 21 and body 5. The securing means 33 may be a threaded wing bolt 33 which has a thumb portion 34 for turning. The threaded wing bolt 33 is secured into threaded portion 32 of front stock locking element 18. Stock 21 has recessed portion 35 for acceptance of the thumb portion 34 of threaded wing bolt 33. Stock 21 has an opening 36 through which threaded wing bolt 33 extends. The threaded wing bolt assembly shown in FIG. 10 may be utilized for securing stock 21 onto device 1. A similar type securing means may be utilized for rear stock locking element 19. One or any plurality desired of any desired type of securing means may be utilized to hold the stock 21 onto the device 1 when device 1 is utilized in a gun or rifle-type arrangement.

FIG. 11 is an elevational view of device 1 as used for hand-held application.

FIG. 12 is an elevational view of device 1 as used in a ground stabilized arrangement. The base 31 of support leg 27 is placed upon the ground 37 or solid object 37. The end cap 6 of loading chamber 2 will also rest upon the ground 37 or solid object 37.

FIG. 13 is an elevational view of device 1 as used in a gun or rifle-type arrangement. Stock 21 is secured onto device 1 by use of securing means 33. The thumb portion 34 of securing means 33 is shown. The thumb portion 38 of the rear securing means (not shown) is shown. The securing means may be located anywhere desired along the stock 21 which performs the function of securing the stock 21 to device 1.

A device is provided that comprises a loading chamber, a loading mechanism, and a firing chamber. An explosive device or firecracker may be placed into the firing chamber by the use of an explosive device holding slot located at the end of the loading mechanism.

Upon explosion of the explosive device or firecracker in the firing chamber, an object is propelled from the device. The present invention provides a method for propelling an object from a device. An explosive device holding slot is provided to safely secure and hold the ignited explosive device or firecracker prior to placing the explosive device or firecracker into the firing chamber of the device. The device may have a stock so that the device can function as a gun or rifle-type weapon, or the device may have ground stabilizing legs so that the device can function in a ground stabilized position. Securing means are provided to secure the stock to the device. Securing means are also provided for the attachment of the ground stabilizing legs.

In the present invention, the explosive device 26, such as a firecracker 26 is dropped into a firing chamber 16 in which the explosion may occur without the possibility of damage to the person utilizing the firecracker 26 for pleasure purposes. The firing chamber 16 may be built of material sufficient to withstand the explosion and the force propelling the ball 8 from the firing chamber portion 3.

The invention calls for igniting the firecracker 26 through the loading opening 10 of loading chamber 2. Once the firecracker 26 is ignited, the loading mechanism 7 is pushed forward so that the explosive device holding slot 24 goes through opening 15 and into the firing chamber 16. The handle portion 22 of loading mechanism 7 is then turned downward to be locked into the locking portion 11 of slide opening 9. With that movement, the explosive device 26 is dropped into the firing chamber 16. The explosive device 26 then explodes propelling the ball 8 from the device 1. At that time the handle portion 22 of loading mechanism 7 would be turned upwards and slide backwards within sliding opening 9 pulling the explosive device holding slot 24 out from the firing chamber 16. The explosive device holding slot 24 would then be located at the loading opening 10. The device 1 is then ready to be loaded with a new explosive device 26 or firecracker 26 as soon as a new ball 8 is placed into the outer opening of firing chamber portion 3.

When the loading mechanism 7 is in the loading position, the outer edge of explosive device holding slot 24 would extend through the opening 15 in rear chamber member 14 so that when the loading mechanism 7 is move forward, there will be no problem in making sure that the loading mechanism 7 slides through the opening 15. The shaft 23 of loading mechanism 7 forms a tight fit within opening 15 of rear chamber member 14 so that when the explosion does occur, the force is propelled at the ball 8 and not back into the desired 1.

End cap 6 prevents the loading mechanism 7 from being pulled back so far that the end of explosive device holding slot 24 might be removed from the opening 15.

The device 1 may be made by any desired manufacturing technique. End cap 6 may be removable or may be made permanent. The device may be made to breakdown into various sections or may be designed in a permanent configuration. The firing chamber portion 3 may be secured to the loading chamber 2 by connecting collar 4 or may be secured together in the manufacturing of the device 1. Any technique utilized in the manufacture of device 1 connecting portions together or changing the shape or design of various portions is within the scope of the invention.

The compressible object 8 may be a ball of any type or may be of any configuration. The principles of the invention will be followed by any configuration of firing chamber portions which includes a firing chamber and an open end in which a compressible object is placed. Any size, shape, or design is contemplated and is within the scope of this invention. After being exploded, the remainder of the explosive device 26 or firecracker 26, may be simply removed by hand or gravity from the firing chamber 16.

The method for propelling an object 8 from the device 1 comprises placing the object 8 in the open end of firing chamber portion 3. An explosive device 26 with a fuse 42 is positioned within the loading mechanism 7. The loading mechanism 7 is secured within the loading chamber 2 of device 1. The fuse 42 of explosive device 26 is ignited. The portion of the loading mechanism 7 holding the explosive device 26 with the fuse 42 is injected into the firing chamber portion 3 of device 1. The explosive device 26 with fuse 42 is dropped into the firing chamber portion 3 from loading mechanism 7. When the explosive device 26 explodes, object 8 is propelled from device 1.

While the invention has been described with reference to specific embodiments, the description is illustrative and is not to be construed as lmiting the scope of the invention. Various modifications and changes may occur to those skilled in the art without departing from the spirit and scope of the invention as defined by the appended claims. *claim:*

1. A method, for propelling an object from a device comprising a loading chamber, a loading mechanism, and a firing chamber portion with an open end, comprising:

a. placing said object in said open end of said firing chamber portion;

b. positioning an explosive device with a fuse within said loading mechanism, with said loading mechanism secured within said loading chamber of said device;

c. igniting said fuse of said explosive device;

d. injecting the portion of said loading mechanism holding said explosive device with said fuse, which has been ignited, into said firing chamber portion of said device; and e. dropping said explosive device with said fuse which has been ignited from said loading mechanism into said firing chamber portion, whereby said explosive device explodes propelling said object from said device.

2. A method according to claim 1 wherein said explosive device is a firecracker.

3. A method according to claim 1 wherein said loading mechanism comprises a holding slot within which said explosive device is positioned.

4. A method according to claim 3 wherein said holding slot has a recessed portion within which a portion of said explosive device is placed.

5. A method according to claim 1 wherein an end portion of said loading mechanism is permanently placed within said firing chamber portion to act as a guide in injecting said portion of said loading mechanism holding said explosive device with said fuse, which has been ignited, into said firing chamber portion of said device.

6. A method according to claim 1 wherein said loading chamber comprises:

a. first opening within which said explosive device may be placed; and b. a second opening through which said loading mechanism can be moved to place said explosive device within said firing chamber portion.

7. A method according to claim 6 wherein said second opening comprises a horizontal section and a vertical section whereby said loading mechanism can be moved horizontally to place said explosive device in said firing chamber portion and vertically to drop said explosive device into said firing chamber portion.

8. A method according to claim 1 wherein said firing chamber portion comprises an open end, a firing chamber, and a rear chamber member with an opening whereby said loading mechanism extends into said firing chamber portion through said opening in said rear chamber member.

9. A method according to claim 1 wherein said loading mechanism comprises a shaft, an explosive device holding slot in the end of said shaft, and a handle portion on the end of said shaft opposite said explosive device holding slot.

10. A device for propelling an object by use of an explosive device comprising:

a. a loading chamber, within which said explosive device is placed into said device, comprising:

(1) a first opening within which said explosive device may be placed; and (2) a second opening through which a loading mechanism can be moved to place said explosive device within a firing chamber portion, said second opening comprising a horizontal section and a vertical section whereby said loading mechanism can be moved horizontally to place said explosive device in said firing chamber portion and vertically to drop said explosive device into said firing chamber portion;

b. a firing chamber portion with an open end secured to said loading chamber and operative for said explosive device to explode within; and c. a loading mechanism secured within said loading chamber and extending into said firing chamber portion of said device and operative to hold said explosive device, whereby when said object is placed within said open end, prior to said explosive device exploding, said object will be propelled from said device upon the explosion of said explosive device.

11. A device according to claim 10 wherein said explosive device is a firecracker.

12. A device according to claim 10 wherein said firing chamber portion comprises an open end, a firing chamber, and a rear chamber member with an opening whereby said loading mechanism extends into said firing chamber portion through said opening in said rear chamber member.

13. A device according to claim 10 wherein said loading mechanism comprises a shaft, an explosive device holding slot in the end of said shaft, and a handle portion on the end of said shaft opposite said explosive device holding slot;.

14. A device according to claim 13 wherein said explosive device holding slot has a recessed portion in which a portion of said explosive device would be placed, and a solid rear portion to aid in securing said explosive device within said explosion device holding slot.

15. A device according to claim 10 further comprising a stock and securing means to secure said stock to said device in order to utilize said device in the manner of a rifle.

16. A device according to claim 10 further comprising a plurality of support legs and leg support means securing said plurality of support legs to said device wherein said device can be set up and utilized on the ground or on a solid surface.

* * * * *